US005465140A

United States Patent [19]

Nakamura et al.

[11] Patent Number: 5,465,140

[45] Date of Patent: Nov. 7, 1995

[54] DEVELOPING DEVICE AND IMAGE FORMING APPARATUS INCLUDING AN AGITATOR HAVING TWO SPRINGS WOUND IN DIFFERENT DIRECTIONS AROUND A ROD

[75] Inventors: Tetsuya Nakamura; Takahito Kabai; Michihisa Iguchi; Seiji Arai; Chinobu Sakai; Satoshi Katagata, all of Tokyo, Japan

[73] Assignee: Kabushiki Kaisha Toshiba, Kanagawa, Japan

[21] Appl. No.: 412,086

[22] Filed: Mar. 27, 1995

Related U.S. Application Data

[63] Continuation of Ser. No. 169,659, Dec. 20, 1993, abandoned.

[30] Foreign Application Priority Data

Dec. 21, 1992 [JP] Japan ..... 4-340228

[51] Int. Cl.[6] ..... G03G 15/06

[52] U.S. Cl. ..... 355/260; 355/208; 355/245; 355/246; 366/279

[58] Field of Search ..... 355/245, 251, 355/253, 255, 260, 246, 208, 215; 118/653, 652, 689–691; 366/320, 279

[56] References Cited

U.S. PATENT DOCUMENTS

| | | | |
|---|---|---|---|
| 4,456,364 | 6/1984 | Hatzis | 355/260 |
| 4,668,074 | 5/1987 | Hirozane | 118/689 X |
| 4,811,867 | 3/1989 | Deyle, Jr. et al. | 355/320 X |
| 4,881,103 | 11/1989 | Seto et al. | 355/251 |
| 4,963,929 | 10/1990 | Ueda et al. | 355/246 X |
| 5,036,363 | 7/1991 | Iida et al. | 355/246 |
| 5,124,752 | 6/1992 | Kanno et al. | 355/253 |
| 5,264,900 | 11/1993 | Momiyama et al. | 355/245 X |
| 5,294,967 | 3/1994 | Munakata et al. | 355/245 X |

FOREIGN PATENT DOCUMENTS

| | | |
|---|---|---|
| 0506423A2 | 9/1992 | European Pat. Off. . |
| 0518682A3 | 12/1992 | European Pat. Off. . |
| 57-196274 | 2/1983 | Japan . |

*Primary Examiner*—A. T. Grimley
*Assistant Examiner*—Shuk Y. Lee
*Attorney, Agent, or Firm*—Finnegan, Henderson, Farabow, Garrett & Dunner

[57] ABSTRACT

A developing device includes an agitator rotated in a toner hopper. The agitator has a rod portion. A first coil spring portion is wound around the first portion of the rod portion in a first direction. A second coil spring portion is wound around the second portion of the rod portion in a second direction. The first direction is opposite to the second direction.

36 Claims, 4 Drawing Sheets

DEVELOPING DEVICE AND IMAGE FORMING APPARATUS INCLUDING AN AGITATOR HAVING TWO SPRINGS WOUND IN DIFFERENT DIRECTIONS AROUND A ROD

This application is a continuation of application Ser. No. 08/169,659, filed Dec. 20, 1993, now abandoned.

FIELD OF THE INVENTION

The present invention relates to a developing device used in an image forming apparatus such as a facsimile and a copying apparatus, and more particularly to a developing device performing an electrophotographic process.

DESCRIPTION OF THE RELATED ART

FIG. 4 shows the structure of a conventional image forming apparatus including a developing device.

A photosensitive drum 1 is rotated in the clockwise direction by a rotary drive mechanism (not shown). A charging device 2, an exposure device 3, a developing device 4, a transfer device 6, and a cleaning device 8 are arranged around the outer surface of the photosensitive drum 1 along the photosensitive drum 1. Of these components, the photosensitive drum 1, the charging device 2, the developing device 4, and the cleaning device 8 are integrally supported by side covers (not shown) to form the process unit 100.

The charging device 2 charges the surface of the photosensitive drum 1 to a predetermined potential (e.g., −600 V).

The developing device 4 comprises a toner hopper 41, a toner pack 42, a feed roller 43, a developing roller 44, a developing blade 45, a support rod 46, a leaf spring 47, a support 48, a reinforcing plate 49, a toner sensor 50 and an agitator 51.

The toner hopper 41 is a hollow container whose upper surfaces are partially open, and stores toner (not shown) therein. The toner pack 42 is mounted on the upper open portion of the toner hopper 41. The toner pack 42 is filled with the toner, and its opening is sealed with a seal sheet (not shown). When the seal sheet is removed and the toner pack 42 is mounted on the toner hopper 41, the toner empties into the toner hopper 41.

The feed roller 43 is arranged at the opening on the side surface of the toner hopper 41 such that it is partly located in the toner hopper 41. The developing roller 44 lightly contacts both the photosensitive drum 1 and the feed roller 43. The feed roller 43 and the developing roller 44 are rotated in the counterclockwise direction by a rotary drive mechanism (not shown). The feed roller 43 carries the toner stored in the toner hopper 41 and supplies it to the developing roller 44. The developing roller 44 carriers the toner given by the feed roller 43 and causes it to contact the surface of the photosensitive drum 1.

The cylindrical support rod 46 is arranged parallel to and above the developing roller 44 to support the developing blade 45 in contact with the developing roller 44. The leaf spring 47, which is fixed to the support 48, urges the support rod 46 toward the developing roller 44 with a predetermined force F. Thus, the developing blade 45 is urged against the developing roller 44. The support 48 is fixed to the side wall of the toner hopper 41.

In the facsimile apparatus having the structure as described above, an image is printed in the following manner.

First, the charging device 2 charges the surface (photosensitive surface) of the photosensitive drum 1 to a predetermined potential (e.g., −600 V). Subsequently, the exposure device 3 exposes the charged photosensitive surface of the photosensitive drum 1 in accordance with an image to be printed, thereby forming an electrostatic latent image. Then, the developing device 4 develops the electrostatic latent image formed on the photosensitive surface of the photosensitive drum 1.

In the developing device 4, the feed roller 43 carries the toner to the developing roller 44. The developing roller 44 carries and conveys the toner. When the developing roller 44 rotates, toner carried on the developing roller 44 receives friction between the developing roller 44 and developing blade 45. As a result, the toner is charged by friction. The urethane resin layer which tends to be charged in positive polarity is provided in the surface of the developing roller 44. The resin layer is charged in the positive polarity by friction with the toner. Accordingly, the toner is charged in the negative polarity due to the polarization effect caused by the resin layer.

A developing bias, for example −200 V, having the same polarity as that of the potential charged on the photosensitive drum 1 is applied to the developing roller 44. The toner selectively attaches to the photosensitive drum 1 by the function of the electric field among the electrostatic latent image, the developing bias, and the charge of toner. More specifically, the toner does not attach to the non-exposed portion of the photosensitive drum 1 since the potential at this portion of the photosensitive drum 1 is more negative than that of the developing roller 44 carrying the toner, and the toner attaches to the exposed portion of the photosensitive drum 1 since the potential at this portion of the photosensitive drum 1 is less negative than that of the developing roller 44 carrying the toner. In this manner, a toner image corresponding to the electrostatic latent image is formed on the surface of the photosensitive drum 1. This toner image is transferred to the printing sheet P by a positive voltage of the transfer device 6.

After the printing sheet P is separated from the photosensitive surface of the photosensitive drum 1, the toner which is not transferred and remains on the surface of the photosensitive drum 1 is removed by the cleaning device 8.

The toner sensor 50 is arranged in a bottom portion of the toner hopper 41. The toner sensor 50 detects that the toner is not present on the toner sensor 50, i.e., that the residual amount of the toner in the hopper 41 is small.

As shown in FIG. 5, both ends of the agitator 51 are formed in the shape of a crank. The agitator 51 includes a toner agitating rod portion 51*a* having a length equivalent to a longitudinal length of the toner hopper 41, arm portions 51*b* and 51*c* extending at right angles relative to the axial direction of the agitating rod portion 51*a*, and supporting portions 51*d* and 51*e* extending oppositely from each other from the arm portions 51*b* and 51*c* and parallel with the toner agitating portion 51*a*. The supporting portions 51*d* and 51*e* are rotatably attached onto both side walls of the toner hopper 41.

Therefore, if the supporting portions 51*d* and 51*e* are rotated, the toner agitating portion 51*a* rotates along a trail as indicated by one-dot chain line in FIG. 4, in the toner hopper 41. Then, the agitator 51 agitates the toner inside the toner hopper 41 and forces the toner to the feed roller 43.

Referring again to FIG. 5, a coil spring 52 is wound around the toner agitating rod portion 51*a* in a single direction. The coil spring 52 touches the toner sensor 50 and sweeps the toner on the toner sensor 50. Therefore, it is possible to prevent the toner from being fixed (i.e., packed) on the toner sensor 50. If the toner is compressed toward the developing roller 44 by an excessive power of an agitator, the toner tends to pass between the developing roller 44 and the blade 45. As a result, the toner does not receive enough friction. For this reason, the coil spring 52 is used to compress the toner by non-excessive power.

However, since the coil spring 52 is wound around the agitator in a single direction, the toner is forced in a direction A corresponding to the direction of the coil spring 52. Therefore, the toner T collects at one side of the toner hopper 41 as shown in FIG. 6.

The toner sensor 50 is arranged generally at the center portion of the toner hopper 41. If the toner T is at one side as explained above, although a great amount of the toner T remains in the toner hopper 41, the toner sensor 50 cannot detect the toner T. Accordingly the toner sensor 50 erroneously detects that the residual amount of the toner T is small and outputs a signal indicative of a low toner level.

In response to the signal from the toner sensor 50, the image forming apparatus urges a user to supplement the toner. When the toner is supplemented in the above state when a great amount of the toner T remains in the toner hopper 41, the amount of the toner T in the toner hopper 41 exceeds a predetermined value. In a case of a developing device in a non-magnetic one-component type image forming apparatus, the toner T receives friction between the developing blade 45 and the developing roller 44. As a result, the toner T is charged. However as the amount of the toner T in the toner hopper 41 increases, the weight of the toner T likewise increases. As a result, some of the toner T tends to pass between the developing blade 45 and the developing roller 44. Therefore, some of the toner T does not receive enough friction between the blade 45 and the roller 44. Accordingly, some of the toner T is not sufficiently charged. This insufficiently charged toner is conveyed to a contact portion N between the developing roller 44 and the photosensitive drum 1. The roller 44 presses the toner to the drum 1. In this case, if the toner T is not sufficiently charged, the electrostatic repulsive force acting on the insufficiently charged toner particles in a non-image portion of the latent image is smaller than the adhesive force which causes the toner particles to be transferred to the photosensitive drum. Therefore, the insufficient charged toner is adhered to not only an image portion of the photosensitive drum 1 but also a non-image portion thereof. The condition in which toner is adhered to the non-imaged portion of the photosensitive drum 1 is called fog.

A relationship between the amount of the toner T inside the toner hopper 41 and fog on the photosensitive drum is shown in FIG. 7. The degree of fog on the photosensitive drum 1 is expressed by a difference in reflectance sampled from a mending tape which is adhered to the photosensitive drum 1 corresponding to non-image background area and from a mending tape which is adhered to a white paper sheet. Referring to FIG. 7, the greater the amount of the toner T inside the toner hopper 41 becomes, the greater fog becomes. Further at the transfer device 6, the toner adhered to the non-imaged portion is transferred to the portion of the paper corresponding to the non-imaged portion at the transfer device 6.

SUMMARY OF THE INVENTION

Accordingly, the present invention has been made in view of the above circumstances and has an object to provide a developing device which decreases fog on a photosensitive drum.

Another object of the present invention is to provide a developing device capable of sweeping toner in a toner hopper certainly.

Additional objects and advantages of the invention will be set forth in part in the description which follows and in part will be apparent from the description, or may be learned by practice of the invention. The objects and advantages of the invention may be realized and attained by means of the instrumentalities and combinations particularly pointed out in the written description and claims hereof as well as the appended drawings. To achieve these and other objects and advantages and in accordance with the purposes of the invention, there is provided a developing device for developing an electrostatic latent image formed on a surface of a photosensitive member by using toner contained in a toner hopper, the developing device comprises agitating means, rotated in the toner hopper, and for agitating the toner and for providing the toner to a developing roller, the agitating means including a rod having a first and second rod portion and a meeting portion where the first rod portion meets the second rod portion, a first coil member wound around the first rod portion of the agitating means toward the meeting portion in a first direction, and a second coil member wound around the second portion of the agitating means toward the meeting portion in a second direction, the second direction being opposite to the first direction.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are incorporated in and constitute a part of this specification, illustrate several embodiments of the invention and, together with the description, serve to explain the objects, advantages, and principles of the invention. In the drawings.

DESCRIPTION OF THE PREFERRED EMBODIMENTS

Reference will now be made in detail to the present preferred embodiments of the invention, examples of which are illustrated in the accompanying drawings.

A developing device in accordance with the present invention will be detailed with reference to the attached drawings.

Figure 1:
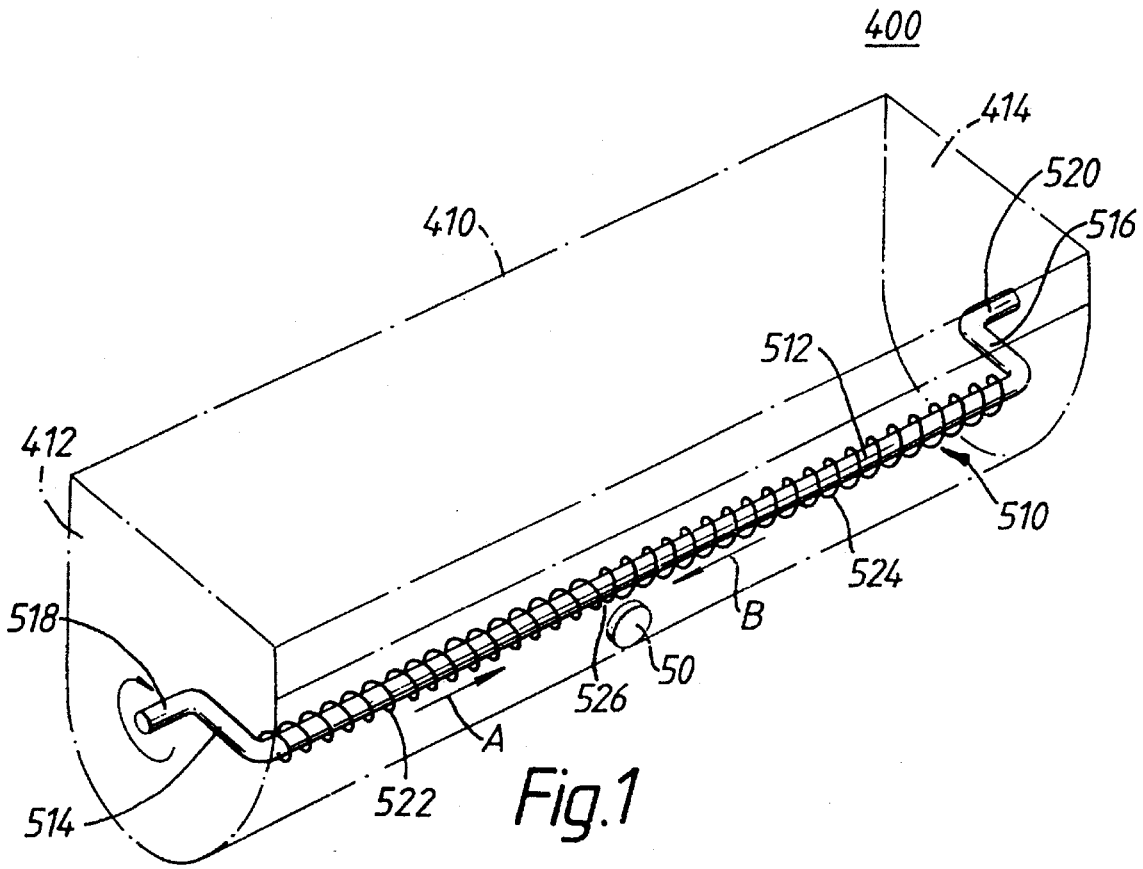
FIG. 1 is a partial perspective view showing one embodiment of the present invention.
Figure 4:
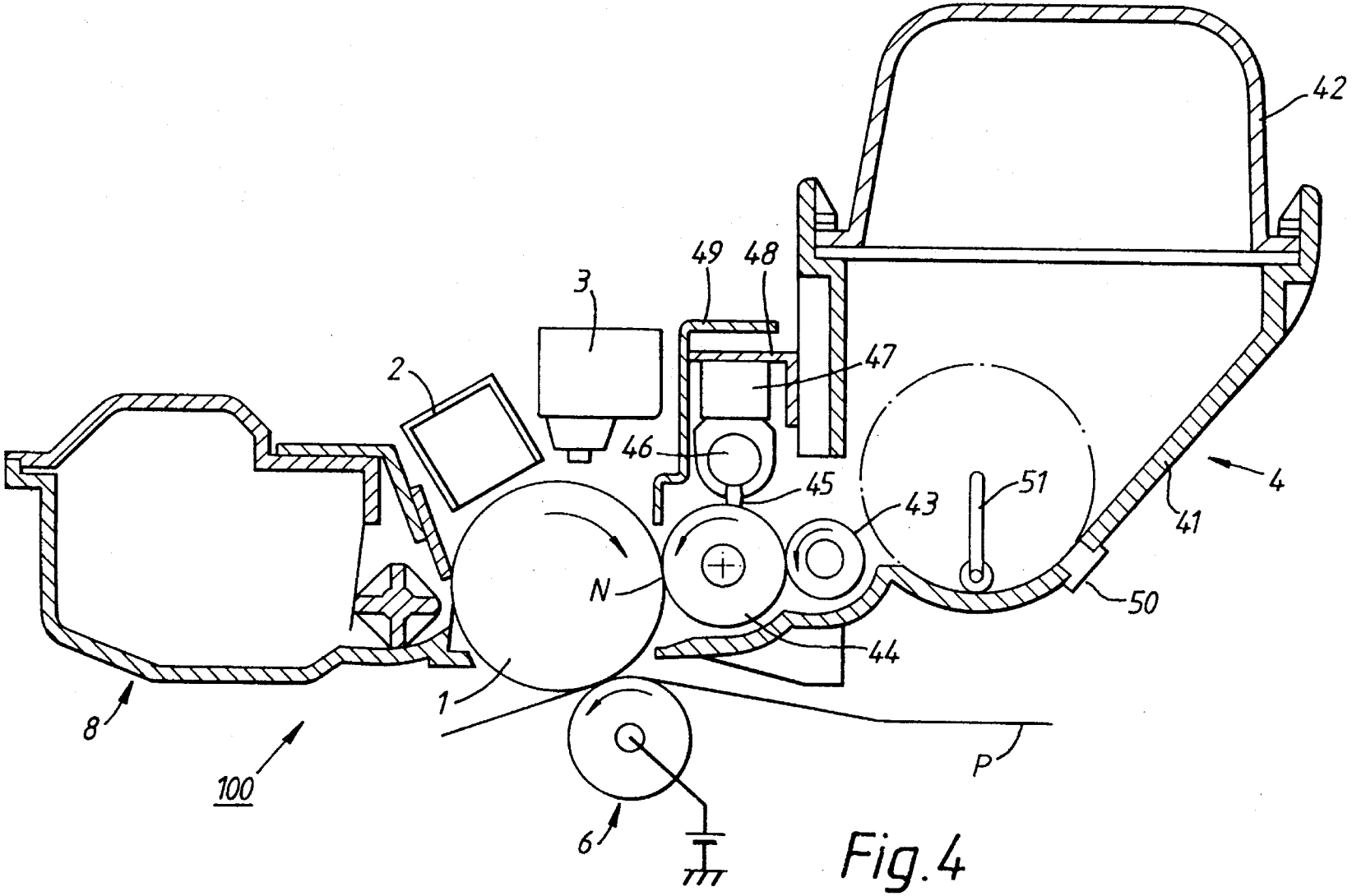
FIG. 4 is a cross-sectional side view showing a conventional image forming apparatus.
Figure 5:
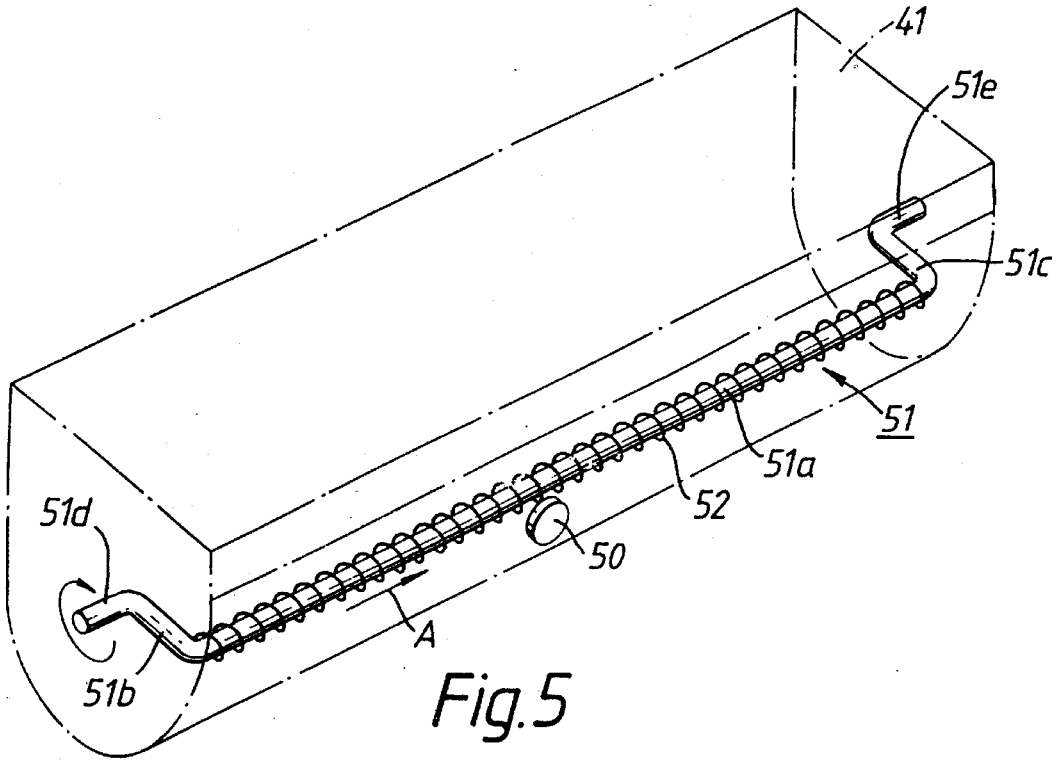
FIG. 5 is a partial perspective view showing a conventional developing device.
Figure 6:
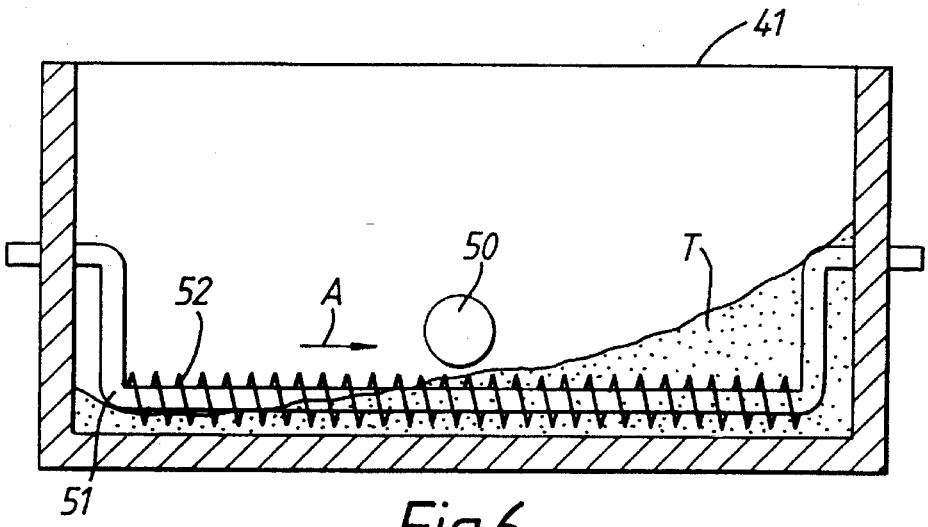
FIG. 6 is a cross-sectional side view showing the conventional developing device.

FIG. 1 shows a developing device 400 provided in an image forming apparatus such as that shown in FIG. 4. Developing device 400 includes a toner hopper 410 having two side walls 412, 414, and an agitator 510 having a toner agitating rod portion 512, arm portions 514 and 516 extending at right angles relative to the axial direction of the agitating rod portion 512, and supporting portions 518 and 520 at ends of the agitator 510. The supporting portions 518 and 520 are rotatably attached to the side walls 412 and 414, respectively. The supporting portions 518 and 520 may be rotated clockwise or counterclockwise. In FIG. 1, the supporting portions are shown as rotating clockwise as viewed by one looking at the structure from the outside of side wall 412. Hereinafter, all reference to the direction of rotation will be described with respect to this viewing perspective for purposes of convenience.

A first coil spring 522 is wound around the toner agitating rod portion 512. The first coil spring 522 is wound clockwise from the end of the arm portion 514 to a center portion of the rod 512 in a first direction A.

A second coil spring 524 is wound around the toner agitating rod portion 512. The second coil spring 524 is wound clockwise from the end of the arm portion 516 to the center portion of the rod 512 in a second direction B. The first and second coil springs 522 and 524 are loosely wound around the rod portion 512. Therefore, the first and second coil springs 522 and 524 are movable in the axial direction of the rod portion 512.

Figure 2:
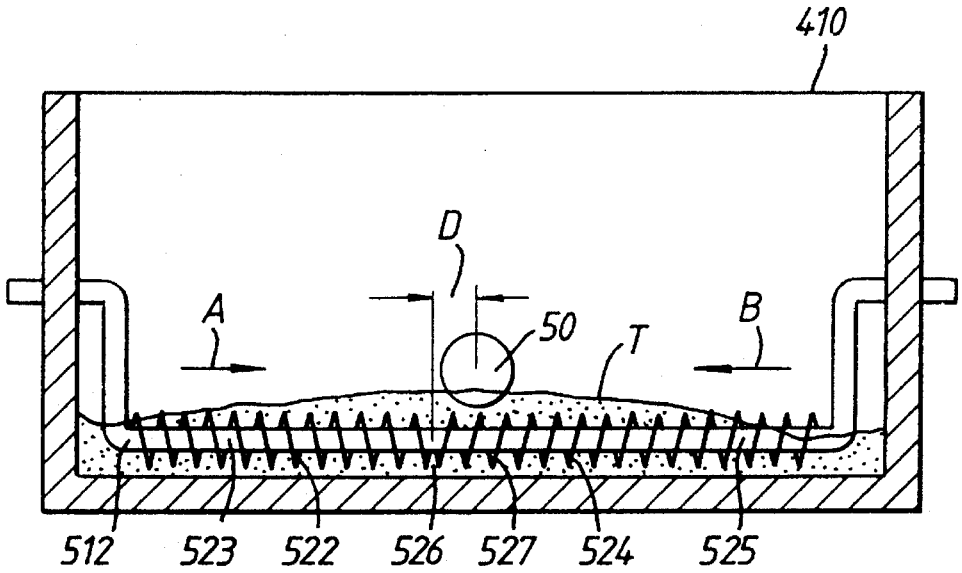
FIG. 2 is a cross-sectional side view showing the embodiment illustrated in FIG. 1.

The first and second coil springs 522, 524 join each other at a joining portion 526 of the toner agitating rod portion 512. A toner sensor 50 is provided within a wall of the toner hopper 410. The toner sensor 50 is axially offset from the joining portion 526 with respect to agitating rod portion 512. The distance between the meeting portion 526 and the toner sensor 50 is represented as D in FIG. 2. The portion from the joining portion 526 to the end of the arm portion 514 is represented as 523. The portion from the joining portion 526 to the end of the arm portion 516 is represented as 525.

In the above embodiment, the first coil spring 522 is wound clockwise from the end of the arm portion 514 to the meeting portion 526 in the first direction A. Further, the second coil spring 524 is wound clockwise from the end of the arm portion 516 to the meeting portion 526 in the second direction B. Therefore, the toner is moved to the joining portion 526 when agitator 510 rotates. As a result, this structure prevents the toner from moving to the side wall of the toner hopper as occurs in the conventional image forming apparatus. Thus, this structure prevents the toner sensor from falsely detecting that no toner is present. Therefore, with this structure, it is unlikely that a user would inadvertently add an excessive amount of toner to the toner hopper. As a result, the toner T receives enough friction between the developing blade 45 and the developing roller 44. Therefore, the toner T is charged sufficiently, and thus, the charged toner is attached to only the image portion of the photosensitive drum. Therefore, the above-described embodiment prevents the fog from occurring on the photosensitive drum.

Further, since the meeting portion 526 is situated a distance away from the toner sensor 50, a portion 527 of the second coil spring 524 sweeps the entire surface of the toner sensor 50 even if the meeting portion 526 moves axially along agitating toner rod 512. Therefore this structure prevents the toner from being fixed on the toner sensor 50.

Figure 3:
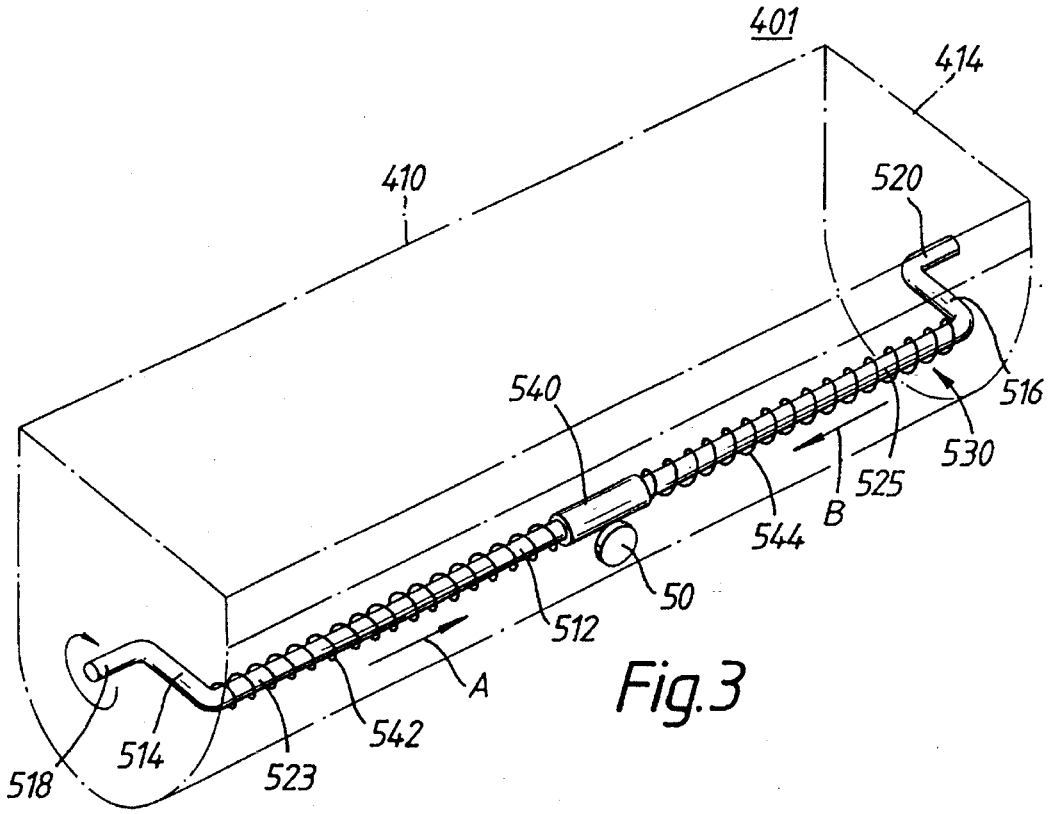
FIG. 3 is a cross-sectional side view showing another embodiment of the present invention.
Figure 7:
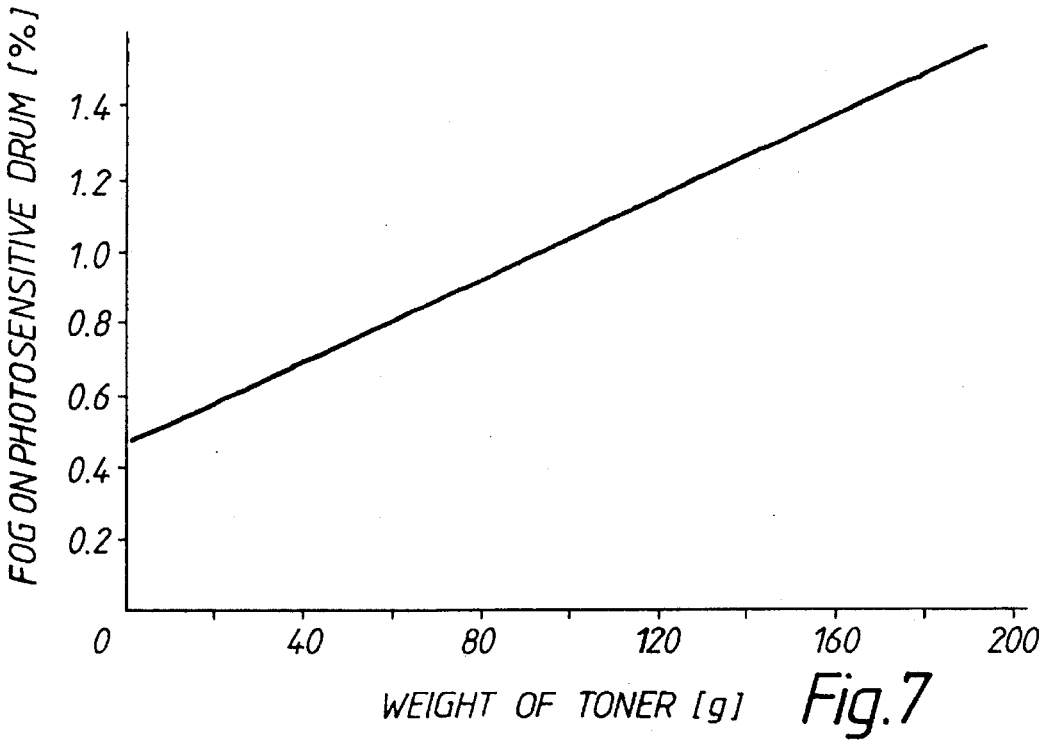
FIG. 7 is a chart showing relationships between fog and weight of the toner in a toner hopper.

FIG. 3 shows a second embodiment of the present invention. The second embodiment differs from the first embodiment with respect to the portion of the second coil spring for sweeping the toner on the toner sensor. Common elements of the second embodiment and the first embodiment, as shown in FIG. 1, have the same reference numerals, and their explanations are omitted.

The second embodiment includes an agitator 530 having the toner agitating rod portion 512 further having an elastic member 540 provided at the center portion of the toner agitating rod portion 512. The toner sensor 50 is positioned within the rotational path of the elastic member 540.

A first coil spring 542 is wound from the end of the arm portion 514 to the center portion of the rod 512 in the first direction A. A second coil spring 544 is wound from the end of the arm portion 516 to the center portion of the rod 512 in the second direction B. When the agitator 530 is rotated, the elastic member 540 contacts all of the surface of the toner sensor 50. The elastic member 540 is formed of an elastic material such as sponge.

In the second embodiment, since the elastic member 540 is provided to sweep off the toner on the toner sensor 50, the toner on the toner sensor 50 is completely swept by the elastic member 540. Therefore, this structure prevents the toner from being fixed on the toner sensor 50.

Further, in the above embodiments, although the first and second coil springs are wound around the toner agitating rod portion, one coil spring having a first portion and a second portion may be provided, the direction in which the first portion is wound about rod 512 being different from the direction in which the second portion is wound about rod 512.

We claim:

1. A developing device for developing an electrostatic latent image formed on a surface of a photosensitive member by using a toner contained in a toner hopper, the developing device comprising:

agitating means for agitating the toner and for providing the toner to a developing roller, the agitating means including a rod having first and second rod portions and a joining portion where the first rod portion joins the second rod portion, wherein the rod is rotated along an inner surface of the toner hopper;

a first coil member loosely wound around the first rod portion of the agitating means to the joining portion in a first winding sense; and a second coil member joined to the first coil member and loosely wound around the second rod portion of the agitating means from the joining portion in a second winding sense, the second winding sense being opposite to the first winding sense.

2. The developing device of claim 1 wherein the rod extends substantially in a same direction as a longitudinal direction of the toner hopper.

3. The developing device of claim 2 wherein the first coil member extends to a center portion of the rod and the second coil member extends to the center portion of the rod.

4. A developing device for developing an electrostatic latent image formed on a surface of a photosensitive member by using a toner contained in a toner hopper the developing device comprising:

agitating means for agitating the toner and for providing the toner to a developing roller, the agitating means including a rod having first and second rod portions and a joining portion where the first rod portion joins the second rod portion, wherein the rod is rotated along an inner surface of the toner hopper;

a first coil member loosely wound around the first rod portion of the agitating means to the joining portion in a first winding sense; and a second coil member joined to the first coil member and loosely wound around the second rod portion of the agitating means from the joining portion in a second winding sense, the second winding sense being opposite to the first winding sense; and detecting means, provided within the toner hopper, for detecting whether toner is present on a surface of the detecting means, the detecting means being swept by the agitating means, wherein the joining portion rotates in a path that is axially offset from the detecting means.

5. The developing device of claim 4, wherein one of the first coil member and the second coil member further includes a sweeping portion for sweeping the detecting means when the agitating means is rotated in the toner hopper.

6. The developing device of claim 4, further comprising an elastic member disposed on the rod between the first and second coil members, the elastic member contacting all of the surface of the detecting means when the agitating means is rotated.

7. The developing device of claim 6, wherein the elastic member includes a sponge.

8. The developing device of claim 1, wherein the first and second coil members are formed of two separate coil spring members joined together.

9. The developing device of claim 1, wherein the first and second coil members are formed from a single coil spring.

10. An image forming apparatus comprising:

a photosensitive member;

exposing means for exposing the photosensitive member to form a latent image on the photosensitive member;

developing means for developing the latent image to form a developed image on the photosensitive member, the developing means including:

a developing roller;

a toner hopper for containing the toner;

agitating means for agitating the toner and for providing the toner to the developing roller, the agitating means including a rod having first and second rod portions and a joining portion where the first rod portion joins the second rod portion, wherein the rod is rotated along an inner surface of the toner hopper;

a first coil member loosely wound around the first rod portion of the agitating means in a first winding sense; and a second coil member joined to the first coil member and loosely wound around the second rod portion of the agitating means in a second winding sense, the second winding sense being opposite to the first winding sense.

11. The developing device of claim 4, wherein the first and second coil spring members are formed of two separate coil spring members joined together.

12. The developing device of claim 4, wherein the first and second coil members are formed from a single coil spring.

13. The image forming apparatus of claim 10, wherein the rod extends substantially the same direction as a longitudinal direction of the toner hopper.

14. The image forming apparatus of claim 13, wherein the first coil member extends to the center portion of the rod and the second coil member extends to the center portion of the rod.

15. The image forming apparatus of claim 10, wherein the first and second coil members are formed of two separate coil spring members joined together.

16. The image forming apparatus of claim 10, wherein the first and second coil members are formed from a single coil spring.

17. An image forming apparatus comprising:

a photosensitive member;

exposing means for exposing the photosensitive member to form a latent image on the photosensitive member;

developing means for developing the latent image to form a developed image on the photosensitive member, the developing means including:

agitating means, rotated in a toner hopper containing toner, for agitating the toner and for providing the toner to a developing roller, the agitating means including a rod having first and second rod portions and a joining portion where the first rod portion joins the second rod portion, wherein the rod is rotated along an inner surface of the toner hopper;

a first coil member wound around the first rod portion of the agitating means to the joining portion in a first winding sense; and a second coil member joined to the first coil member and wound around the second rod portion of the agitating means from the joining portion in a second winding sense, the second winding sense being opposite to the first winding sense; and detecting means, provided within the toner hopper, for detecting whether toner is present on a surface of the detecting means, the detecting means being swept by the agitating means, wherein the joining portion rotates in a path that is axially offset from the detecting means.

18. The image forming apparatus of claim 17, further comprising an elastic member disposed on the rod between the first and second coil members, the elastic member contacting all of the surface of the detecting means when the agitating-means is rotated.

19. The image forming apparatus of claim 18, wherein the elastic member includes a sponge.

20. The image forming apparatus of claim 17, wherein one of the first coil member and the second coil member further includes a sweeping portion for sweeping the detecting means when the agitating means is rotated in the toner hopper.

21. The image forming apparatus of claim 17, wherein the first and second coil members are formed of two separate coil spring members joined together.

22. The image forming apparatus of claim 17, wherein the first and second coil members are formed from a single coil spring.

23. The developing device of claim 6, wherein the elastic member is cylindrically shaped and coaxially disposed on the rod.

24. The image forming apparatus of claim 18, wherein the elastic member is cylindrically shaped and coaxially disposed on the rod.

25. The developing device of claim 4, wherein the rod extends substantially parallel to a long dimension of the toner hopper.

26. The developing device of claim 25, wherein the first rod portion and the second rod portion are equal in length, the joining portion including the center of the rod, and the first coil member and the second coil member each extend to the center of the rod.

27. The developing device of claim 4, wherein the first and second coil members comprise respective first and second coil spring members.

28. The developing device of claim 4, wherein the first and second coil members are portions of a continuous coil member.

29. The image forming apparatus of claim 17, wherein the rod extends substantially parallel to a long dimension of the toner hopper.

30. The image forming apparatus of claim 17, wherein the first rod portion and the second rod portion are equal in length, the joining portion including the center of the rod, and the first coil member and the second coil member each extend to the center of the rod.

31. The image forming apparatus of claim 17 wherein the first and second coil members comprise respective first and second coil spring members.

32. The image forming apparatus of claim 17, wherein the first and second coil members are portions of a continuous coil member.

33. The developing device of claim 1, further comprising a toner friction member that charges by friction the toner provided to the developing roller by the agitating means.

34. The developing device of claim 4, further comprising a toner friction member that charges by friction the toner provided to the developing roller by the agitating means.

35. The developing device of claim 10 further comprising a toner friction member that charges by friction the toner provided to the developing roller by the agitating means.

36. The developing device of claim 17, further comprising a toner friction member that charges by friction the toner provided to the developing roller by the agitating means.

* * * * *